US006405404B2

(12) United States Patent
Babkowski

(10) Patent No.: US 6,405,404 B2
(45) **Date of Patent: *Jun. 18, 2002**

(54) PAINT ROLLER FRAME

(75) Inventor: William I. Babkowski, Salisbury, MD (US)

(73) Assignee: The Sherwin-Williams Company, Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,103

(22) Filed: Dec. 23, 1998

Related U.S. Application Data

(60) Provisional application No. 60/072,713, filed on Jan. 13, 1998.

(51) Int. Cl.[7] ..... B05C 1/08; B05C 17/02

(52) U.S. Cl. ..... 15/230.11; 492/13; 492/19

(58) Field of Search ..... 15/230.11; 492/14, 492/16, 17, 18, 19, 13

(56) References Cited

U.S. PATENT DOCUMENTS

| | | | | |
|---|---|---|---|---|
| 2,520,863 A | | 8/1950 | Thomas et al. | 15/27 |
| 2,675,605 A | | 4/1954 | Thomas | 29/116 |
| 2,982,010 A | | 5/1961 | Johns | 29/116 |
| 3,119,137 A | * | 1/1964 | Schueler | 15/230.11 |
| 3,447,184 A | | 6/1969 | McGinley | 15/230.11 |
| 3,623,180 A | * | 11/1971 | Anderson | 15/230.11 |
| 3,751,748 A | | 8/1973 | Roe et al. | 15/230.11 |
| 3,986,226 A | | 10/1976 | Roe et al. | 15/230.11 |
| 4,295,241 A | * | 10/1981 | Woolcock | 15/230.11 |
| 4,332,067 A | * | 6/1982 | Pearce | 15/230.11 |
| 4,402,102 A | | 9/1983 | Al-Samman | 15/230.11 |
| 5,490,303 A | | 2/1996 | Graves | 15/230.11 |
| 5,619,769 A | | 4/1997 | Hutt | 15/230.11 |
| 5,755,004 A | | 5/1998 | Miller | 15/230.11 |

FOREIGN PATENT DOCUMENTS

| | | | | |
|---|---|---|---|---|
| FR | 1402540 | * | 5/1965 | 15/230.11 |

* cited by examiner

*Primary Examiner*—Gary K. Graham
(74) *Attorney, Agent, or Firm*—Vivien Y. Tsang; Robert E. McDonald; James A. Hudak

(57) ABSTRACT

A paint roller frame which securely retains a paint roller cover thereon during painting and which permits the roller cover to be easily removed therefrom is disclosed. The paint roller frame includes a cage assembly comprising a cage body and oppositely disposed end caps having bores therein permitting the passage of the paint roller frame therethrough. The inboard end cap includes a plurality of circumferentially spaced-apart longitudinally extending ribs which securely engage the inner surface of the paint roller cover during the painting process and which permit the easy removal of the roller cover therefrom when painting has been completed or when the roller cover needs replacement.

1 Claim, 2 Drawing Sheets

PAINT ROLLER FRAME

This application claims the benefit of U.S. Provisional Application(s) Ser. No(s). 60/072,713, filed on Jan. 13, 1998.

TECHNICAL FIELD

The present invention relates, in general, to a paint roller frame having a cage assembly attached thereto and, more particularly, to a paint roller frame and cage assembly which securely retains a paint roller cover thereon during painting and which permits the paint roller cover to be easily removed therefrom after usage or for replacement purposes.

BACKGROUND ART

There are numerous types of paint roller frames and cage assemblies that permit the removal of the roller cover therefrom for replacement purposes. Such removal and/or replacement entails varying degrees of difficulty since if it is relatively easy to remove the roller cover from the cage assembly, the roller cover is usually not positively retained in place on the cage assembly and thus can move longitudinally relative thereto during painting. Conversely, if the roller cover is securely retained on the cage assembly, it is relatively difficult to remove it therefrom for replacement purposes or at the time painting has been completed. Such is the case with the paint roller frame disclosed in U.S. Pat. No. 5,345,648 (Graves) wherein the paint roller cover is retained on the cage assembly by a Belleville type washer having a plurality of radially extending prongs which grip the inner surface of the roller cover. Since the prongs become embedded in the inner surface of the roller cover, it is extremely difficult to remove the roller cover from the cage assembly in this case.

Another inherent disadvantage of most paint roller frames is that the cage assemblies used to support the roller cover include areas where paint may become entrapped, thus making the cage assemblies difficult to clean. Also, some cage assemblies do not provide uniform support for the roller cover permitting the roller cover to develop flat spots or become out of round making the roller cover less effective in spreading paint.

Because of the foregoing inherent disadvantages associated with presently available paint roller frames, it has become desirable to develop a paint roller frame which positively retains the roller cover thereon during painting while allowing the roller cover to be quickly and easily removed therefrom for replacement purposes or when painting has been completed. Furthermore, the resulting paint roller frame should be easy to clean and should provide substantial uniform support to the surface of the roller cover.

SUMMARY OF THE INVENTION

The present invention solves the problems associated with the prior art paint roller frames and other problems by providing a paint roller frame having a cage assembly which positively retains the roller cover thereon during painting and still permits the roller cover to be easily removed therefrom when desired. The cage assembly includes a cage body comprising a plurality of circumferentially spaced-apart, longitudinally extending roller cover support bars joined together by a plurality of arcuate ribs interposed between the support bars. An outboard end cap is received over the outboard end of the cage body while an inboard end cap is received over the inboard end thereof. A centrally located bore is provided in the hub portions of each of the aforementioned end caps permitting the shaft portion of the paint roller frame to be received therethrough allowing rotation of the cage assembly about the shaft of the paint roller frame. The inboard end cap has a plurality of circumferentially spaced-apart longitudinally extending ribs which grippingly engage the inner surface of the inboard end of the roller cover to securely retain the roller cover on the cage assembly. When painting has been completed or when it is desired to replace the roller cover, the paint roller frame with the roller cover thereon can be oriented vertically with the outboard end cap being located lower than the inboard end cap and by rapping the inboard side of the paint roller frame against a solid surface, the weight of the paint roller cover, with the paint retained therein, causes the roller cover to become disengaged from the longitudinally extending ribs on the inboard end cap resulting in the roller cover dropping from the cage assembly.

Accordingly, an object of the present invention is to provide a paint roller frame which securely retains the roller cover thereon during painting and still permits the roller cover to be quickly and easily removed therefrom for replacement purposes or after painting has been completed.

Another object of the present invention is to provide a paint roller frame having a structure which permits paint to easily drain therefrom and which minimizes the amount of paint entrapped therein.

Still another object of the present invention is to provide a paint roller frame which provides substantial uniform support for the paint roller cover over the length thereof.

DESCRIPTION OF THE PREFERRED EMBODIMENT

Figure 1:
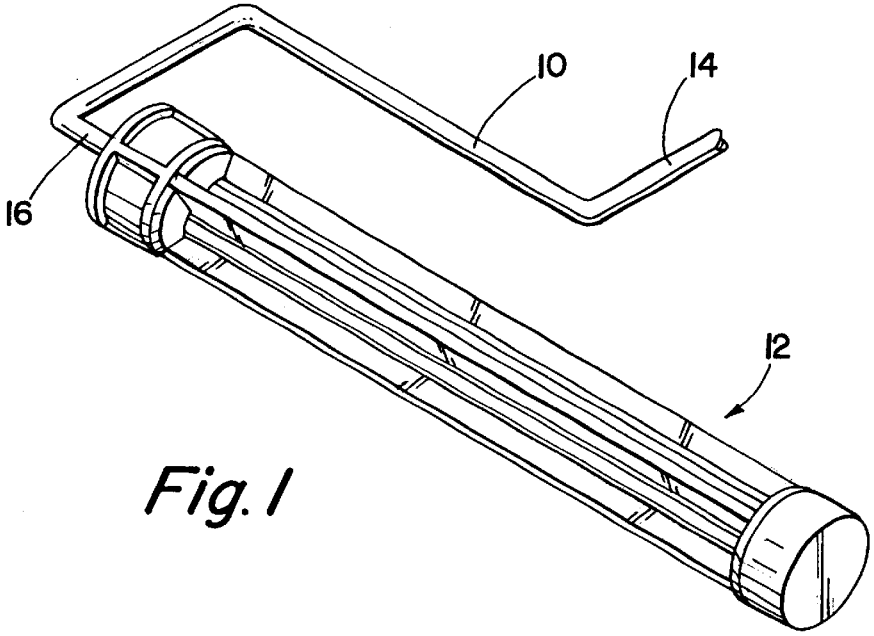
FIG. 1 is a perspective view of the paint roller frame and cage assembly of the present invention.

Referring now to the drawings where the illustrations are for the purpose of describing the preferred embodiment of the present invention and are not intended to limit the invention described herein, FIG. 1 is a perspective view of a paint roller frame 10 with a cage assembly, shown generally by the numeral 12, attached thereto. The frame 10 is formed from heavy gauge wire or rod that is bent so as to provide a handle portion 14 at one end thereof and the shaft portion 16 at the other end thereof for rotatably supporting the cage assembly 12 thereon. Typically, a hand grip (not shown), which may be made of plastic or wood, is attached to the end of the handle portion 14 to assist in gripping the paint roller frame 10 with one hand. A threaded socket (not shown) may be provided in the outer end of the hand grip to permit attachment of an extension pole, if desired.

Figure 2:
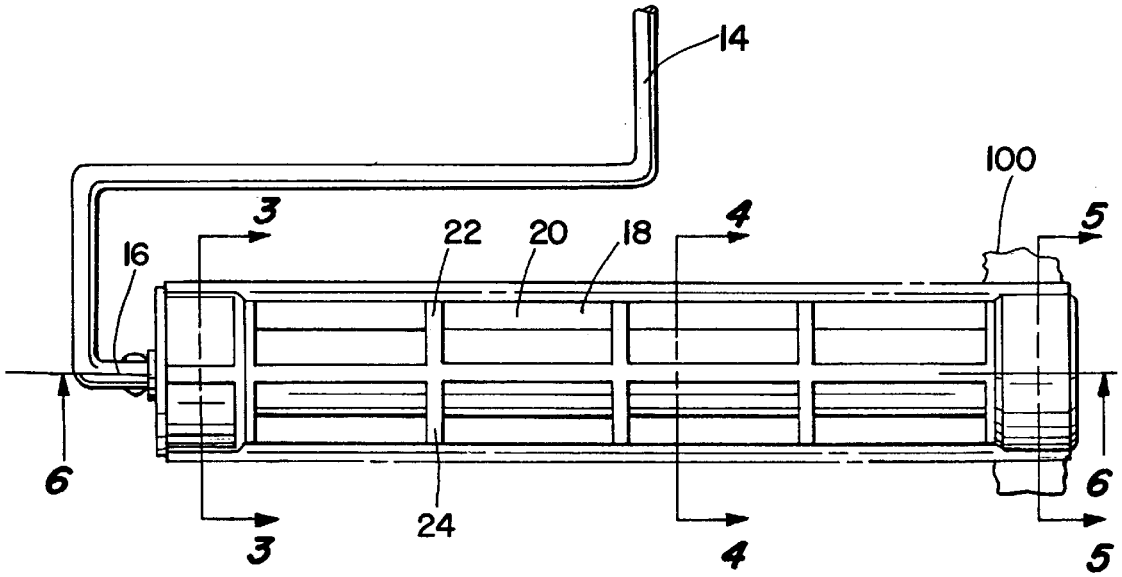
FIG. 2 is a front elevational view of the paint roller frame and cage assembly of the present invention with a roller cover received thereon.

The cage assembly for the present invention can be any structure that can support a roller cover thereon. For illustration purposes only, as shown in FIG. 2, the cage assembly 12 may be molded of a nylon material, such as Delrin or the like, and includes a substantially rigid one-piece cage body 18 having a substantially circular cross-section and comprised of a plurality of circumferentially spaced, longitudinally extending roller cover support bars 20 joined together at a plurality of axially spaced-apart locations by arcuate ribs 22 interposed between the support bars 20. The support bars 20 are substantially straight and of uniform height over their entire length, the height of the ribs 22 corresponding to the height of the support bars 20, and the ribs 22 are joined to the bars 20 forming axially spaced annular rings 24 each having an outer diameter that is slightly less than the inner diameter of a paint roller cover resulting in the outer diameter of the cage body 18 being slightly less than the inner diameter of the paint roller cover to be received thereon.

Figure 6:
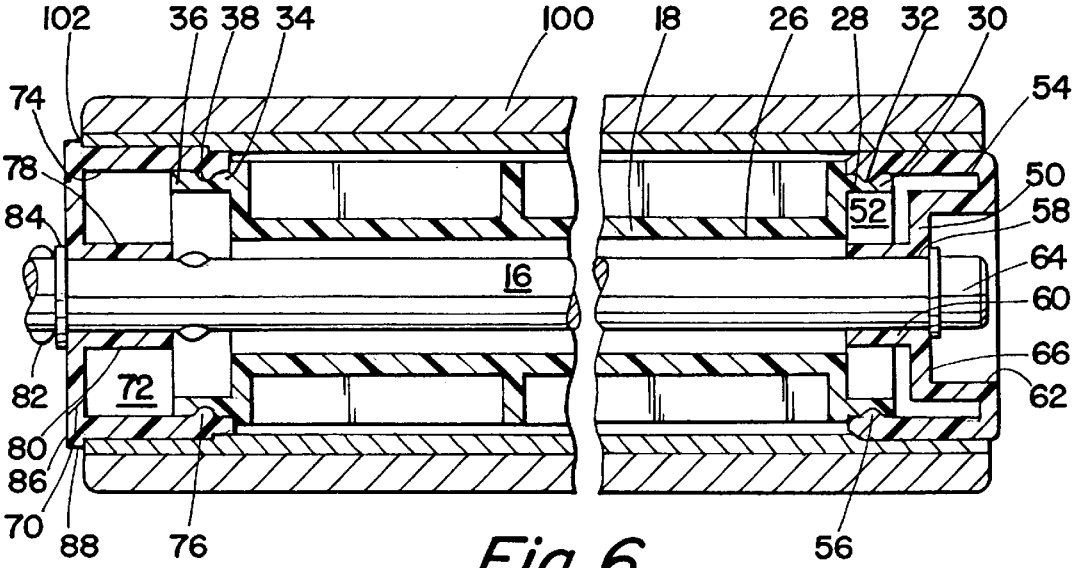
FIG. 6 is a cross-sectional view of the paint roller frame and cage assembly taken across section-indicating lines 6—6 in FIG. 2.

As shown in FIG. 6, the cage body 18 has an axial opening 26 therethrough to receive the shaft portion 16 of the frame 10. The outboard end of the cage body 18 is provided with a longitudinally extending circumferential surface 28 terminating in a chamfered surface 30. A circumferential groove 32 is provided in the longitudinally extending circumferential surface 28. The inboard end of the cage body 20 is similarly provided with a longitudinally extending circumferential surface 34 terminating in a chamfered surface 36. As in the case of the outboard end of the cage body 18, a circumferential groove 38 is also provided in the longitudinally extending circumferential surface 34.

An end cap 50, which may also be molded of a nylon material, such as Delrin or the like, and having a substantially circular cross-section with an outer diameter approximating the inner diameter of the paint roller cover to be received thereon, is provided to cover the outboard end of the cage body 18. The end cap 50 has an annular recess 52 formed therein. The diameter of circumferential surface 54 defining annular recess 52 approximates the outer diameter of the longitudinally extending circumferential surface 28 on cage body 18. An inwardly directed circumferential lip 56, having a configuration complementary to circumferential groove 32 in the longitudinally extending circumferential surface 28 on cage body 18, is provided on the circumferential surface 54 of end cap 50. The inner diameter of the inwardly directed circumferential lip 56 approximates the root diameter of circumferential groove 32. A centrally located bore 58 is provided in hub portion 60 of end cap 50 and terminates in a blind bore 62 on the outboard side of end cap 50. End cap 50 is received over the longitudinally extending circumferential surface 28 on cage body 18 permitting the longitudinally extending circumferential surface 28 to be received in annular recess 52 in end cap 50 and allowing inwardly directed circumferential lip 56 to be received in circumferential groove 32 on the longitudinally extending circumferential surface 28. In this manner, end cap 50 is lockingly engaged with longitudinally extending circumferential surface 28 on cage body 18. Chamfered surface 30 on the end of longitudinally extending surface 28 on cage body 18 acts as a pilot surface for the receipt of end cap 50 thereon. The shaft portion 16 of the frame 10 is received through bore 58 in hub portion 60 of end cap 50 so that its end is positioned in blind bore 62. A cap nut 64 is received on the end of shaft portion 16 of frame 10 and is positioned within blind bore 62 and abuts the surface 66 which defines the bottom of blind bore 62. A cap (not shown) may be provided to cover the opening to blind bore 62.

Similarly, an end cap 70, which may also be formed of Delrin or the like and having a substantially circular cross-section, is provided to cover the inboard end of the cage body 18. The end cap 70 has an annular recess 72 therein. The diameter of circumferential surface 74 defining annular recess 72 approximates the outer diameter of the longitudinally extending circumferential surface 34 on cage body 18. An inwardly directed circumferential lip 76, having a configuration complementary to circumferential groove 38 in the longitudinally extending surface 34 on cage body 18, is provided on circumferential surface 74 of end cap 70. The inner diameter of inwardly directed lip 76 approximates the root diameter of the circumferential groove 38. A bore 78 is provided in hub portion 80 of end cap 70. End cap 70 is received over the longitudinally extending circumferential surface 34 on cage body 18 permitting the longitudinally extending circumferential surface 34 to be received within annular recess 72 in end cap 70 and allowing inwardly directed circumferential lip 76 to be received in circumferential groove 38 on longitudinally extending circumferential surface 34. In this manner, end cap 70 is lockingly engaged with longitudinally extending circumferential surface 34 on cage body 18. Chamfered surface 36 on the end of longitudinally extending surface 34 on cage body 18 acts as a pilot surface for the receipt of end cap 70 thereon. The shaft portion 16 of the frame 10 is received through bore 78 in hub portion 80 and is staked outwardly thereof forming oppositely disposed ears 82. A washer 84 is received over shaft portion 16 of frame 10 and is interposed between oppositely disposed ears 82 and end 86 of end cap 70.

Figure 3:
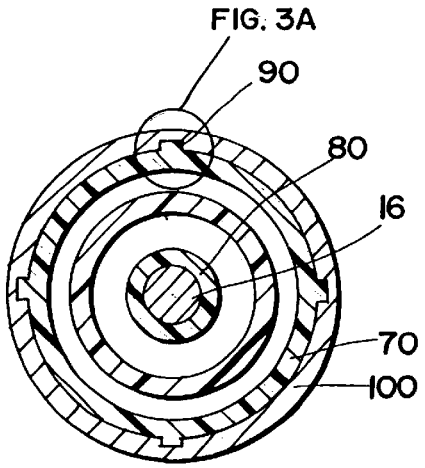
FIG. 3 is a cross-sectional view of the inboard end cap of the cage assembly taken across section-indicating lines 3—3 in FIG. 2.
Figure 4:
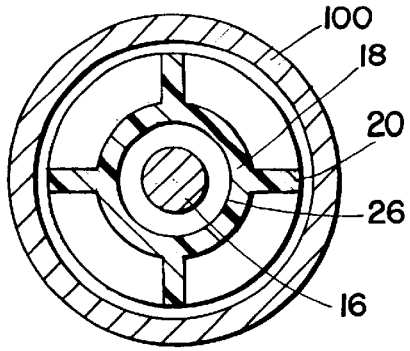
FIG. 4 is a cross-sectional view of the cage assembly taken across section-indicating lines 4—4 in FIG. 2.
Figure 5:
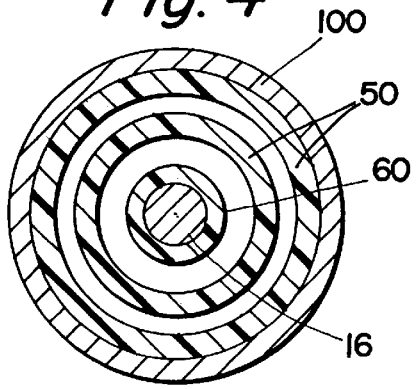
FIG. 5 is a cross-sectional view of the outboard end cap of the cage assembly taken across section-indicating lines 5—5 in FIG. 2.
Figure 3A:
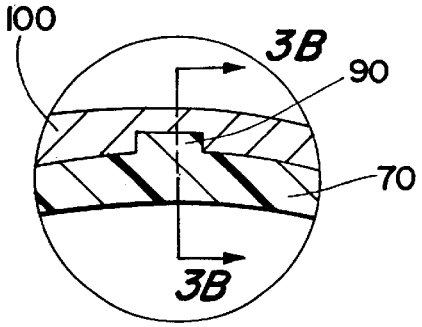
FIG. 3A is an enlarged cross-sectional view of the inboard end cap shown in FIG. 3 and illustrates a longitudinally extending rib thereon.
Figure 3B:
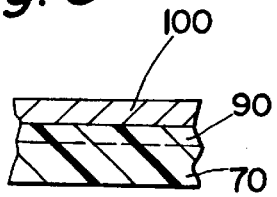
FIG. 3B is a cross-sectional view taken across section-indicating lines 3B—3B in FIG. 3A.

End 86 of inboard end cap 70 is provided with an outwardly directed circumferential flange 88. As shown in FIG. 3, the outer surface of inboard end cap 70 is provided with four (4) circumferentially spaced-apart longitudinally extending ribs 90 which originate adjacent the inboard end of end cap 70 and terminate at the outwardly directed circumferential flange 88. The diameter across oppositely positioned longitudinally extending ribs 90 is slightly greater than the inner diameter of the paint roller cover to be received thereon. The diameter across oppositely disposed longitudinally extending ribs 90 should be sufficient to tightly and frictionally engage the paint roller cover to be received thereon, yet allow an easy disengagement during the removal process. Typically, the diameter across oppositely disposed longitudinally extending ribs 90 is at least 0.020 inches greater than the inner diameter of the paint roller cover.

In order to install a paint roller cover 100 on paint roller frame 10, the paint roller cover 100 is slidingly received over outboard end cap 50, roller cover support bars 20, and inboard end cap 70 until the end 102 of paint roller cover 100 abuts outwardly directed circumferential flange 88 on end cap 70. When the paint roller cover 100 is so installed on paint roller frame 10, the longitudinally extending ribs 90 on end cap 70 engage the inner surface of the paint roller cover 100 preventing the roller cover 100 from becoming disengaged from the frame 10. When painting has been completed, the paint roller frame 10, with the paint roller cover 100 thereon, is oriented vertically with outboard end cap 50 being positioned so as to be located lower than inboard end cap 70. By rapping the inboard side of the shaft portion 16 of the paint roller frame against a solid surface, the weight of the paint roller cover 100, with the paint retained therein, causes the roller cover 100 to become disengaged from the longitudinally extending ribs 90 and to drop from the roller frame 10. Since the ribs 90 are oriented in the same direction as longitudinal axis of the roller cover 100, and thus, in the direction of motion of the roller cover 100 during the removal process, the paint roller cover 100, with the paint retained therein, can be easily removed from frame 10 for disposal purposes without the painter touching the roller cover 100.

Certain modifications and improvements will occur to those skilled in the art upon reading the foregoing. It should be understood that all such modifications and improvements have not been expressly set forth herein for the sake of conciseness and readability, but are properly within the scope of the following claims.

I claim:

1. A paint roller frame and cage assembly supporting a paint roller cover having a substantially tubular configuration, said frame comprising a handle portion and a shaft portion, said cage assembly being rotatably mounted on said shaft portion of said frame, said cage assembly comprising a cage body, a first end cap substantially covering one end of said cage body, said first end cap having a substantially smooth outer surface, and a second end cap covering the other end of said cage body, said second end cap having an inboard end and an outboard end and a plurality of circumferentially spaced-apart longitudinally extending ribs thereon for engagement with the surface defining the inner diameter of the roller cover, said second end cap including a circumferentially flanged surface adjacent said outboard end thereof, said circumferentially flanged surface acting as a stop for the roller cover, said longitudinally extending ribs originating adjacent to but spaced apart from said inboard end of said second end cap and terminating at said circumferentially flanged surface on said outboard end of said second end cap, the radial height and transverse width of each of said longitudinally extending ribs being substantially constant along the longitudinal length of said rib resulting in each of said longitudinally extending ribs being substantially rectangular in cross-section, said plurality of said longitudinally extending ribs grippingly engaging the surface defining the inner diameter of the roller cover when the roller cover is received thereon while maintaining the portions of said second end cap interposed between adjacent longitudinally extending ribs in an undistorted configuration causing said longitudinally extending ribs to grippingly engage and outwardly deflect the surface defining the inner diameter of the roller cover.

* * * * *